United States Patent [19]

Van Husen

[11] Patent Number: 5,056,471

[45] Date of Patent: Oct. 15, 1991

[54] INTERNAL COMBUSTION ENGINE WITH TWO-STAGE EXHAUST

[76] Inventor: Norman R. Van Husen, 46000 Geddies Rd.-Lot 189, Canton, Mich. 48188

[21] Appl. No.: 597,545

[22] Filed: Oct. 12, 1990

[51] Int. Cl.[5] ..... F02B 75/28

[52] U.S. Cl. ..... 123/51 R; 123/57 R; 60/620

[58] Field of Search ..... 123/51 R, 51 A, 51 AA, 123/51 B, 51 BA, 64, 57 R, 57 A, 57 B; 60/620

[56] References Cited

U.S. PATENT DOCUMENTS

| | | | |
|---|---|---|---|
| 1,443,885 | 1/1923 | Owen | 123/51 A |
| 1,771,335 | 7/1930 | Karpes | 123/64 |
| 1,773,995 | 8/1930 | Goldsborough | 60/620 |
| 2,196,228 | 4/1940 | Prescott | 60/15 |
| 4,159,699 | 7/1979 | McCrum | 60/620 |
| 4,159,700 | 7/1979 | McCrum | 60/620 |
| 4,237,832 | 12/1980 | Hartig et al. | 123/64 |
| 4,599,863 | 7/1986 | Marttila | 60/620 |
| 4,787,343 | 11/1988 | Tuckey | 123/59 EC |
| 4,917,054 | 4/1990 | Schmitz | 123/64 |

FOREIGN PATENT DOCUMENTS

| | | | |
|---|---|---|---|
| 3433619 | 2/1986 | Fed. Rep. of Germany | 123/51 R |
| 0091324 | 6/1982 | Japan | 123/51 R |
| 0113238 | 6/1984 | Japan | 60/620 |
| 0128921 | 7/1984 | Japan | 60/620 |

*Primary Examiner*—David A. Okonsky
*Attorney, Agent, or Firm*—Robert G. Mentag

[57] ABSTRACT

An internal combustion engine is provided having pairs of separately designated combustion and exhaust cylinders for implementing a two-stage exhaust system which derives work from the combustion gases of the combustion cylinders. The piston within each exhaust cylinder is timed by the engine's crankshaft to lead its corresponding combustion cylinder's piston by roughly a 30 to 90 degree crankshaft angle. Ignition of a combustible fuel mixture within the combustion cylinder produces combustion gases. The expansion of the combustion gases drives the combustion piston during a power stroke, and are expelled from the combustion cylinder during an exhaust stroke. The combustion gases exit the combustion cylinder via a fluidic passage to the exhaust cylinder. The combustion gases are received by the exhaust cylinder at the start of its piston's intake stroke. The timing between the combustion and exhaust piston is such that the combustion gases exert a force upon the exhaust piston during its intake stroke. From there, the combustion gases are expelled from the exhaust cylinder during its piston's exhaust stroke.

4 Claims, 2 Drawing Sheets

INTERNAL COMBUSTION ENGINE WITH TWO-STAGE EXHAUST

BACKGROUND OF THE INVENTION

1. Field of the Invention

The present invention generally relates to internal combustion engines having reciprocating pistons. More specifically, this invention relates to an internal combustion engine having separately designated combustion and exhaust cylinders through which a two-stage exhaust system is implemented for deriving work from the combustion gases of the combustion cylinders.

2. Description of the Prior Art

Internal combustion (IC) engines currently are by far the predominant engine form used today for purposes of providing power to propel motorized vehicles, as well as many other forms of transportation and recreation devices. The IC engine is preferred, for its exceptional power and weight ratio and energy storage potential (miles traveled between refueling), when compared to other comparable forms of automotive power. However, concern for the environment and for preservation of natural resources has continuously encouraged efforts to improve the efficiency, performance and fuel economy of IC engines while reducing their noxious emissions and noise.

Various arrangements have been suggested to improve the combustion efficiency of IC engines by providing engines with intercooperating cylinders having different designated functions. One example of this in U.S. Pat. No. 4,715,326 to Thring. Thring discloses pairs of cylinders in which the first cylinder of each pair compresses an air/fuel mixture which is then transferred through a passageway to the second cylinder of the pair. Combustion of the compressed air/fuel mixture takes place within the second cylinder by means of a catalyst within the passageway. The advantage to the engine arrangement taught by Thring is the benefits of fuel injection without the need for a fuel injector, and further the reduction of pollutants within the combustion gases. However, Thring does not directly extract any additional benefit from the combustion gases generated by the cylinder arrangement disclosed.

A second example of intercooperating cylinders is taught in U.S. Pat. No. 2,196,228 to Prescott. Prescott discloses a first cylinder which provides supercharged air to a second cylinder prior to ignition of a combustible mixture in the second cylinder. Following combustion, the first cylinder also acts to assist in exhausting the combustion gases from the second cylinder by being timed such that the first piston lags the second piston, thereby providing an additional exhaust stroke closely timed to the exhaust stroke of the second cylinder. However, the first cylinder is not timed so as to extract any of the energy remaining within the combustion gases of the second cylinder.

Because a substantial amount of the energy generated by an IC engine is lost through the exhausting of the combustion gases, efforts have been made to utilize the hot combustion gases to more completely combust the original air/fuel mixture. An example of this approach is U.S. Pat. No. 4,068,628 which teaches the mixing of additional air with the combustion gases of a majority of an engine's cylinders for purposes of further combustion in a pair of designated exhaust burning cylinders. Another example disclosed in U.S. Pat. No. 4,787,343 the combustion gases to atomize and vaporize the air/fuel mixture prior to injection into the engine's cylinders. However, both of the above U.S. patents are directed towards full combustion of the original air/fuel mixture and neither attempt to directly use the combustion gases alone for deriving additional work from the engine.

From the above discussion of IC engines, it can be readily appreciated that neither the references having intercooperating cylinders nor the references promoting more complete combustion attempt to derive any benefit directly from the enormous energy potential possessed by the combustion gases.

Therefore, it would be desirable to provide an IC engine which derives power directly from the combustion gases for additional power to drive designated pistons of the engine. It would be additionally desirable that such an IC engine provide improved fuel economy while reducing pollutants exhausted into the atmosphere.

Accordingly, what is needed is an IC engine which diverts the combustion gases generated in a first cylinder to a second cylinder for purposes of stroking a piston within the second cylinder, thereby providing additional torque to the crankshaft of the engine.

SUMMARY OF THE INVENTION

According to the present invention there is provided an IC engine having at least two cylinders, generally referred to as a first cylinder and a second cylinder. The first and second cylinders have a first piston and a second piston, respectively, which reciprocally reside within their respective cylinders. The first and second pistons are reciprocated by any conventional means, such as an engine crankshaft, between top dead center (TDC), where they are furthest from the crankshaft axis, and bottom dead center (BDC) at which time they are at their nearest point to the crankshaft axis. The second piston is timed by the crankshaft to lead the first piston by a predetermined crankshaft angle such that the second piston is already retreating from TDC when the first piston reaches TDC.

The first cylinder has a first intake port and a first exhaust port. The first intake port is open during the intake stroke of the first piston, but is closed by a first intake valve during the first piston's compression, power and exhaust strokes. The first cylinder also has a first exhaust port which is open during the exhaust stroke of the first piston, but is otherwise closed by a first exhaust valve during the intake, compression and power strokes of the first piston.

The second cylinder is also provided with intake and exhaust ports, designated the second intake port and the second exhaust port. The second exhaust port is open during the exhaust stroke of the second piston, but is closed during the second piston's power stroke by a second exhaust valve. A fluidic passage is provided between the exhaust port of the first cylinder and the intake port of the second cylinder for purposes to be explained later.

In the operation of the IC engine, a combustible air/fuel mixture is drawn into the first cylinder through the first cylinder's intake valve during the first piston's intake stroke. The combustible fuel mixture is then compressed within the first cylinder during the first piston's compression stroke and is ignited just prior to TDC at the end of the compression stroke. Ignition is accomplished by any suitable igniter, such as a conventional engine spark plug, provided preferably adjacent the intake and exhaust ports of the first cylinder.

Upon ignition, the combustible fuel mixture produces combustion gases within the first cylinder. The expansion of the combustion gases drives the first piston toward BDC during the first piston's power stroke, and the gases are expelled from the first cylinder during the first piston's exhaust stroke. The combustion gases exit the first cylinder via its exhaust port and flow through the fluidic passage to the second cylinder, entering the second cylinder through its intake port.

The combustion gases are received by the second cylinder at the start of the second piston's intake stroke. The timing between the first and second pistons is such that the combustion gases exert a force upon the second piston during its intake stroke, in a sense transforming the second piston's intake stroke into a power stroke. From there, the combustion gases are expelled from the second cylinder via the second cylinder's exhaust port during the exhaust stroke of the second piston.

According to a preferred aspect of the present invention, an advantageous feature is that the combustion gases of the first cylinder are not merely exhausted to atmosphere, but are directly used to derive additional work from the engine. As a result, the output torque of an IC engine in accordance with the present invention is greater than that of a comparably sized IC engine having the same number of combustion cylinders.

In addition, a significant advantage of the present invention is that, by reducing the number of combustion cylinders required to obtain a given output torque, the quantity of pollutants produced is reduced in comparison to a convention IC engine providing the same output.

Accordingly, it is an object of the present invention to provide an IC engine having separately designated but cooperating combustion and exhaust cylinders through which a two-stage exhaust system is implemented for deriving work from the combustion gases of the combustion cylinders.

It is a further object of this invention that such an engine use the combustion gases of the combustion cylinders to drive the reciprocating pistons of the exhaust cylinders, thereby producing more output torque than a comparable engine having the same number of combustion cylinders of equal displacement.

It is yet another object of this invention that such an engine more effectively utilize the energy potential within the combustion gases which would otherwise be lost by exhausting to atmosphere.

It is still a further object of this invention that such an engine produce fewer pollutants, while generating a given amount of torque, in relation to the quantity of pollutants produced by a comparable engine which generates the same amount of torque, but which is not equipped with the teachings of the present invention.

Other objects and advantages of this invention will be more apparent after a reading of the following detailed description taken in conjunction with the drawings provided.

DESCRIPTION OF THE PREFERRED EMBODIMENT

Figure 1:
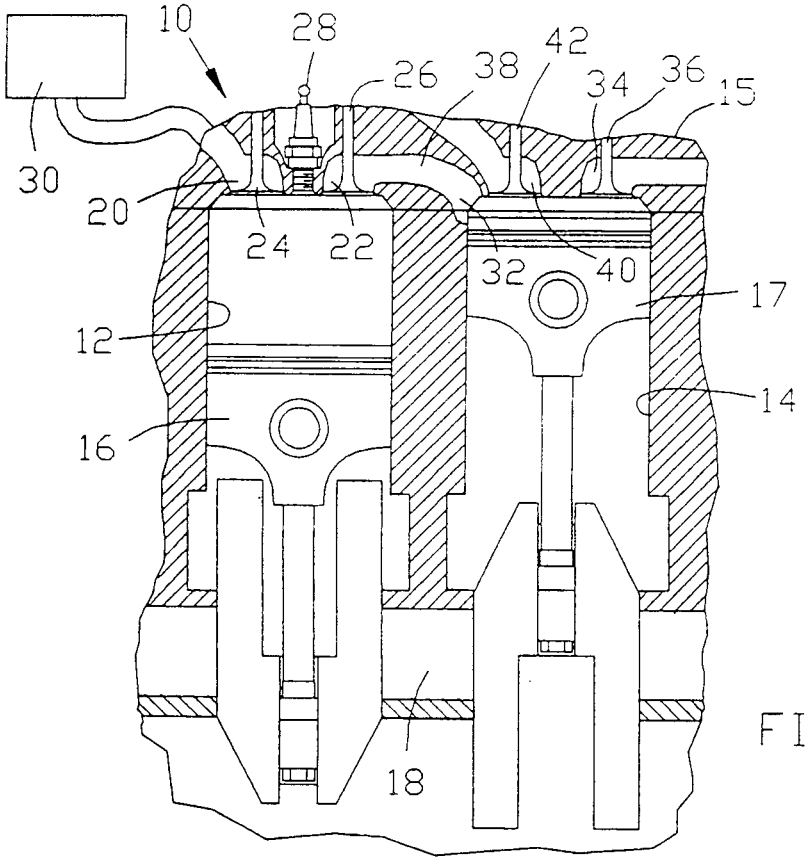
FIG. 1 is a schematic view, partly in cross-section, of a carbureted four-stroke internal combustion engine with spark-ignition in accordance with a preferred embodiment of this invention.

In a preferred embodiment of this invention, the internal combustion (IC) engine 10 is provided with at least one pair of cylinder pairs, as shown in FIG. 1. The cylinder pairs can be oriented in any manner, such as in-line, opposing, or at some angle therebetween such as in a conventional V-8 engine. Each pair consists of a combustion cylinder 12 and an exhaust cylinder 14. A cylinder head 15 encloses the upper end of both the combustion and exhaust cylinders 12 and 14. The combustion cylinder 12 and exhaust cylinder 14 have a combustion piston 16 and exhaust piston 17, respectively, which reciprocally reside within their respective cylinders. Both the combustion piston 16 and the exhaust piston 17 are reciprocated by any conventional means, such as an engine crankshaft 18.

For purposes of discussion, the preferred embodiment shown in FIG. 1 is a four-stroke spark-ignition IC engine. As such, the combustion piston 16 of FIG. 1 reciprocates successively through four distinguishable strokes during one complete cycle: an intake stroke, a compression stroke, a power stroke and an exhaust stroke. The operation of the exhaust piston 17 differs slightly and will be explained below under the discussion of the exhaust cylinder 14.

The combustion cylinder 12 has an intake port 20 and an exhaust port 22, both of which are preferably located in the cylinder head 15. The intake port 20 and exhaust port 22 are closeable by an intake valve 24 and an exhaust valve 26, respectively. Both the intake and exhaust valve 24 and 26 are actuated by any conventional valve cam arrangement (not shown) which is timed to operate in cooperation with the crankshaft 18. An air/fuel mixing device, such as a carburetor 30 as illustrated or in the alternative a fuel injector, is in fluidic communication with the intake valve 20 of the combustion cylinder 12 for metering the fuel mixture requirements to the combustion cylinder 12.

The intake valve 24 operates to open the intake port 20 for the intake stroke of the combustion piston 16, and closes the intake port 20 for the compression, power and exhaust strokes of the combustion piston 16. Conventional timing of the intake valve 24 will have the intake port 20 opening at a crankshaft angle of approximately 10 to 15 degrees prior to the combustion piston 16 reaching top dead center (TDC) before the beginning of the intake stroke.

The exhaust valve 26 operates to open the exhaust port 22 for the exhaust stroke of the combustion piston 16, and closes the exhaust port 22 for the intake, compression and power strokes of the combustion piston 16. Conventional timing of the exhaust valve 26 will have the exhaust port 22 opening at a crankshaft angle of approximately 45 to 60 degrees prior to the combustion piston 16 reaching bottom dead center (BDC) before the beginning of the exhaust stroke. For the purpose of illustration, the preferred embodiment is a spark-ignition engine requiring the combustion cylinder 12 to also be provided with an ignition spark plug 28. The spark plug 28 initiates combustion within the combustion cylinder 12, typically between a crankshaft angle of 0 and 40 degrees, prior to TDC during the compression stroke of the combustion piston 16.

The exhaust piston 17 reciprocates within the exhaust cylinder 14 such that the exhaust piston leads the combustion piston 16 by a crankshaft angle of approximately 30 to 90 degrees. As a result, the exhaust piston 17 will be retreating from TDC at the time the combustion piston 16 is at TDC. Unlike the combustion cylinder 12, the exhaust cylinder 14 is not supplied with the air/fuel mixture of the carburetor 30. Consequently, the exhaust piston 17 lacks true intake, compression, power and exhaust strokes, though the exhaust piston 17 still operates through four distinguishable strokes which constitute one complete cycle. Therefore, the operation of the exhaust piston 17 will be described as operating successively through an intake-power stroke, an exhaust stroke, an intake-purge stroke and an exhaust-purge stroke, all of which will be more fully described below.

The exhaust cylinder 14 has an intake port 32 and an exhaust port 34 located in the cylinder 15. The exhaust port 34 is closeable by an exhaust valve 36 which, in similar fashion to the intake and exhaust valves 24 and 26 of the combustion cylinder 12, is actuated by any conventional valve cam arrangement (not shown). The exhaust valve 36 operates to close the exhaust port 34 during the intake-power stroke while opening the exhaust port 34 during the exhaust stroke of the exhaust piston 17.

A fluidic passage 38 is located between and is in communication with the combustion cylinder's exhaust port 22 and the exhaust cylinder's intake port 32. The intake port 32 is continuously open and in communication with the fluidic passage 38 throughout the operation of the exhaust piston 17. As will be explained next, this aspect is particularly advantageous in that the exhaust cylinder 14 is capable of receiving the combustion gases from the combustion cylinder 12 during the exhaust stroke of the combustion piston 16.

In the operation of the preferred embodiment, the carburetor 30 introduces the combustible air/fuel mixture to the combustion cylinder 12 through its intake port 20, the combustible mixture being drawn into the combustion cylinder 12 during the intake stroke of the combustion piston 16. The combustible mixture is subsequently compressed within the combustion cylinder 12 during the compression stroke of the combustion piston 16. As noted above, just prior to the combustion piston 16 reaching TDC, the spark plug 28 ignites the combustible mixture, driving the combustion piston 16 toward BDC during the power stroke. Near the end of the power stroke the exhaust port 22 of the combustion cylinder 12 is opened by the exhaust valve 26. Thereafter, the combustion piston 16 forces the combustion gases into the fluidic passage 38 during the exhaust stroke of the combustion piston 16.

At the time the combustion piston 16 reaches TDC following the exhaust stroke , the exhaust piston 17 is already moving away from TDC by the aforementioned 30to 90 degree crankshaft angle lead. The combustion gases, being forcibly expelled from the combustion cylinder 12 through its exhaust port 22, travel through the fluidic passage 38, entering the exhaust cylinder 14 through the exhaust cylinder's intake port 32. The combustion gases in turn exert a force upon the exhaust piston 17 during the exhaust piston's intake-power stroke. The exhaust piston 17, having thus derived work from the combustion gases of the combustion cylinder 12, thereafter expels the combustion gases from the exhaust cylinder 14 during the exhaust stroke of the exhaust piston 17.

Following the expulsion of the combustion gases from the exhaust cylinder 14, the exhaust piston 17 continues as previously described through the intake-purge, when the exhaust piston 17 travels toward BDC, and exhaust-purge strokes, when the exhaust piston 17 returns to TDC. As it is not desirable on efficiency grounds to draw a vacuum during the intake-purge stroke, the present invention provides for two alternatives. In the first alternative, the exhaust cylinder's exhaust valve 36 opens the exhaust port 34 during both the intake-purge and exhaust purge strokes to further purge the exhaust cylinder 14 of the combustion gases admitted during the intake-power stroke of the exhaust piston 17. Because combustion gases will be drawn through the exhaust port 34 from the exhaust manifold (Not shown), this action does not actually purge the exhaust cylinder 14 of combustion gases, but does act to assist in cooling of the exhaust piston 17 and the wall of the exhaust cylinder 14.

The second alternative is to provide an auxiliary intake port 40 and an auxiliary intake valve 42 to the exhaust cylinder 14. The auxiliary intake valve 42, which also is actuated by the valve cam arrangement (not shown) noted above, vents the auxiliary intake port 40 to atmosphere during the intake-purge stroke. The exhaust cylinder's exhaust port 34 is then opened by its exhaust valve 36 during the exhaust-purge stroke of the exhaust piston 17. Consequently, fresh air is drawn into the exhaust cylinder 14 through the auxiliary intake port 40 during the intake-purge stroke and is then expelled through the exhaust port 34 during the exhaust-purge stroke of the exhaust piston 17.

Though the IC engine 10 of FIG. 1 is discussed in terms of a four-stroke engine with spark ignition, the teachings of the present invention are not limited as such and can be successfully employed with other reciprocating piston engines, such as two-stroke and diesel engines. The operation of a four-stroke diesel engine incorporating the present invention is nearly identical to the above description except that the air/fuel mixture is provided by fuel injection means, such as a conventional fuel injector, and the air/fuel mixture is auto-ignited, eliminating the need for a spark ignition device.

Figure 2:
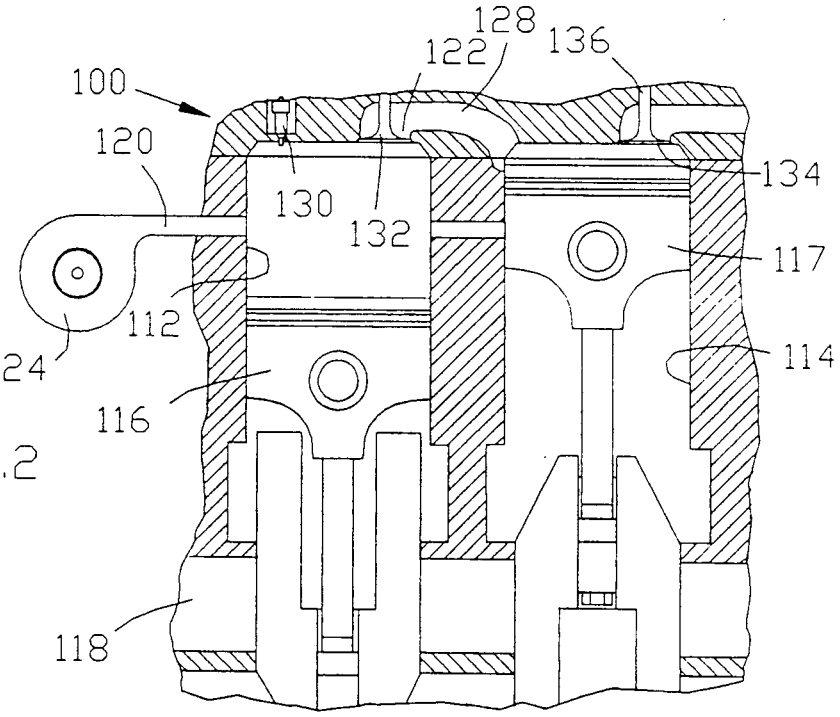
FIG. 2 is a schematic view, partly in cross-section of a fuel injected two-stroke internal combustion engine with auto-ignition in accordance with a preferred embodiment of this invention.

In contrast, operation of a two-stroke engine differs enough to warrant further discussion. A two-stroke diesel engine 100 is illustrated in FIG. 2 to highlight the operational differences. The descriptions and functions of the components of the present invention are generally applicable to both four and two-stroke engines. Though many forms of two-stroke engines provide intake and exhaust ports in the sidewall of the combustion cylinder, the following will be described in terms of a construction very similar to the above for reasons of clarity.

In operation of the two-stroke diesel engine 100, air is forced by a blower 124 into a combustion cylinder 112 through an intake port 120 toward the end of a power stroke as a combustion piston 116 nears BDC. As the combination piston 116 returns from BDC and travels upward, it begins a compression stroke in which the air is compressed. At the end of the compression stroke as the combustion piston 116 nears TDC, a combustible fuel is injected into the combustion cylinder 112 through an injector 130, whereupon the compressed air/fuel mixture auto-ignites. As the resulting combustion gases expand the combustion piston 116 is forced downwardly to begin the power stroke BDC. As the combustion piston 116 continues downwardly, an exhaust port 122 is opened to expel the combustion gases into the fluidic passage 128. As the combustion piston 16 continues its downward travel, the intake port 120 is again opened to allow in air, and the above cycle is repeated.

Within an exhaust cylinder 114, the combustion gases are received via the fluidic passage 128 as an exhaust piston 17 is traveling downwardly during its power stroke toward BDC. The gases impart a force on the exhaust piston 117 to further urge it downwardly. Near the end of the power stroke the combustion gases are exhausted through an exhaust port 134, whereupon the exhaust piston 117 passes through BDC and again returns to TDC to repeat the above cycle.

Figure 3:
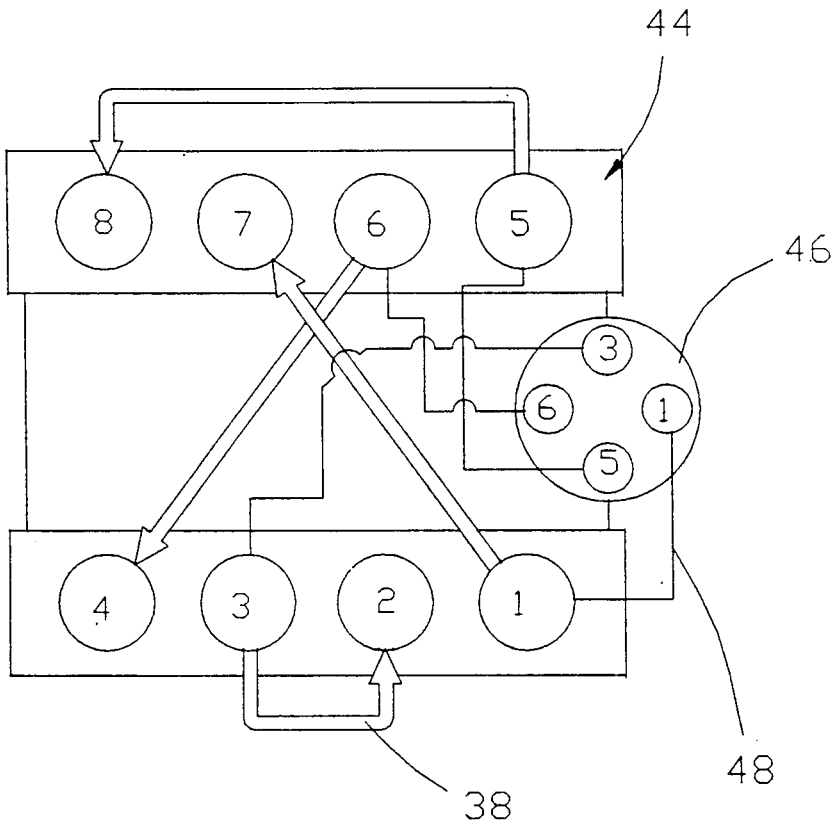
FIG. 3 is a schematic representation of a preferred firing order for a V-8 internal combustion engine in accordance with a preferred embodiment of this invention.

FIG. 3 is a schematic representation of a V-8 engine 44 which has been modified to incorporate the teachings of the present invention. For illustrative purposes a stock V-8 engine which does not incorporate the present V-8 engine 44, but is otherwise identical to the present V-8 engine 44, has a firing order of 1-3-7-2-6-5-4-8. As modified to practice the present invention, the V-8 engine 44 has a firing order of 1-3-6-5, as indicated by the engine's distributor 46 and the distributor wiring 48 which electrically connects the distributor 46 to the combustion cylinders 1, 3, 6 and 5.

FIG. 3 also shows the combustion cylinders as each being in communication with their corresponding exhaust cylinders via corresponding fluidic passages 38. Combustion cylinder number 1 is in communication with exhaust cylinder number 7, combustion cylinder number 3 is in communication with exhaust cylinder number 2, combustion cylinder number 6 is in communication with exhaust cylinder number 4, and combustion cylinder number 5 is in communication with exhaust cylinder number 8. As will be readily apparent to one skilled in the art, the example illustrated in FIG. 3 is only a representation of a firing order which is adapted for purposes of practicing the present invention. Those skilled in the art will be able to readily adapt the teachings of the present invention to engines having a different number of cylinders and various firing orders.

A significant advantage of the preferred embodiment is that the combustion gases of the first cylinder are not merely exhausted to atmosphere, but are directly used to derive additional work from the engine. As a result, the output torque of an IC engine, in accordance with the preferred embodiment, is greater than that of a comparably sized IC engine having the same number of combustion cylinders. As an example, an eight cylinder engine, modified to have four combustion cylinders 12 and four exhaust cylinders 14, in accordance with the teachings of the present invention, will produce more output torque than a four cylinder engine with cylinders having the same displacement, though less than an identical but unmodified eight cylinder engine.

In addition, a significant advantage of the present invention is that, by reducing the number of combustion cylinders required to obtain a given output torque, the quantity of pollutants produced is reduced in comparison to a conventional IC engine providing the same or a lesser output. As an example, an eight cylinder engine, modified to have four combustion cylinders 12 and four exhaust cylinders 14, in accordance with the teachings of the present invention, will produce no more pollutants than a four cylinder engine with cylinders having the same displacement, though it will produce half of the pollutants that an identical but unmodified eight cylinder engine will produce.

While the invention has been described in terms of a preferred embodiment, it is apparent that other forms could be adopted by one skilled in the art. Examples are relocating the intake and exhaust ports of the cylinders for improved gas dynamics, and modifying the fluidic passage 28 to enhance flow characteristics. Accordingly, the scope of the invention is to be limited only by the following claims.

What is claimed is:

1. An internal combustion reciprocating piston engine (10) comprising:

(a) a first cylinder (12), said fist cylinder (12) having ignition means (28) associated therewith;

(b) a first cylinder piston (16), reciprocally residing within said first cylinder (12), said first cylinder piston (16) being reciprocated by a first reciprocating means, said first cylinder piston (16) successively having a first intake stroke, a first compression stroke, a first power stroke and a first exhaust stroke;

(c) a first cylinder intake port (20) located in said first cylinder (12);

(d) a first cylinder intake valve (24) operatively associated with said first cylinder intake port (20), said first cylinder intake valve (24) being capable of closing said first cylinder intake port (20) by operation of a first camming means in communication therewith, said first cylinder intake port (20) being opened by said first cylinder intake valve (24) during a first cylinder intake stroke of said first cylinder piston (16), said first cylinder intake port (20) being closed by said first cylinder intake valve (24) during a first cylinder compression stroke, a first cylinder power stroke and a first cylinder exhaust stroke of said first cylinder piston (16);

(e) a first cylinder exhaust port (22) located in said first cylinder (12);

(f) a first cylinder exhaust valve (26) operatively associated with said first cylinder exhaust port (22), said first cylinder exhaust valve (26) being capable of closing said first cylinder exhaust port (22) by operation of a second camming means in communication therewith, said first cylinder exhaust port (22) being opened by said first cylinder exhaust valve (26) during said exhaust stroke of said first cylinder piston (16), said first cylinder exhaust port (22) being closed by said first cylinder exhaust valve (26) during said intake stroke, said compression stroke and said power stroke of said first cylinder piston (16);

(g) a second cylinder (14) in communication (22) (38) (32) with said first cylinder (12);

(h) a second cylinder piston (17) reciprocally residing within said second cylinder (14), said second cylinder piston (17) being reciprocated by a second reciprocating means, said second cylinder piston (17) leading said first cylinder piston (16) by approximately a 30 to 90 degree phase angle such that said second cylinder piston (17) is retreating from top dead center when said first cylinder piston (16) is at top dead center, said second cylinder piston (17) successively having a second cylinder intake-power stroke, a second cylinder exhaust stroke, a second cylinder intake-purge stroke and a second cylinder exhaust-purge stroke;

(i) a second cylinder intake port (32) located in said second cylinder (14);

(j) a second cylinder exhaust port (34) located in said second cylinder (14);

(k) a second cylinder exhaust valve (36) operatively associated with said second cylinder exhaust port (34), said second cylinder exhaust valve (36) being capable of closing said second cylinder exhaust port (34) by operation of a third camming means in communication therewith, said second cylinder exhaust port (34) being opened by said second cylinder exhaust valve (36) during said exhaust stroke of said second cylinder piston (17), said second cylinder exhaust port (34) being closed by said second cylinder exhaust valve (36) during said intake-power stroke of said second cylinder piston (17);

(l) fluidic communication means (38) between said first cylinder exhaust port (22) and said second cylinder intake port (32);

(m) fuel supply means (30) for providing a combustible fuel to said first cylinder (12) through said first cylinder intake port (20), said combustible fuel being introduced into said first cylinder (12) during said intake stroke of said first cylinder piston (16);

(n) said combustible fuel producing combustion gases within said first cylinder (12) upon ignition of said combustible fuel mixture by an ignition means, said combustion gases being expelled from said first cylinder (12) during said exhaust stroke of said piston (16);

(o) said combustion gases flowing to said second cylinder (14) via said first cylinder exhaust port (22), said fluidic communication means (38) and said second cylinder intake port (32);

(p) said combustion gases being received by said second cylinder (14) during said intake-power stroke of said second cylinder piston (17), said combustion gases being expelled from said second cylinder (14) during said exhaust stroke of said second cylinder piston (17);

(q) an auxiliary intake port (40) located in said second cylinder (14) and an auxiliary intake valve (42) operatively associated with said auxiliary intake port (40);

(r) said second cylinder auxiliary intake valve (40) being capable of closing said second cylinder auxiliary intake port (40) by operation of a fourth camming means in communication therewith;

(s) said second cylinder auxiliary intake port (40) being opened by said second cylinder auxiliary intake valve (42) during the intake-purge stroke of said second cylinder piston (17); and, (t) said second cylinder auxiliary intake port (40) being closed by said second cylinder auxiliary intake valve (42) during the exhaust stroke of said second cylinder piston (17).

2. An internal combustion engine (10) as defined in claim 1, wherein:

(a) said combustible fuel is compressed within said first cylinder (12) during the compression stroke of the first cylinder piston (12).

3. An internal combustion engine (10) as defined in claim 1, wherein:

(a) said combustion gases exert a force upon said second cylinder piston (17) during the intake-power stroke of the second cylinder piston (17).

4. An internal combustion engine (10) as defined in claim 1, wherein:

(a) said second cylinder exhaust port (34) is opened by said second cylinder exhaust valve (36) during the intake-purge stroke and the exhaust-purge stroke of said second cylinder piston (17).

* * * * *

UNITED STATES PATENT OFFICE

CERTIFICATE OF CORRECTION

Patent No. 5,056,471 Dated October 15, 1991

Inventor(s) Norman R. Van Husen

It is certified that error appears in the above-identified patent and that said Letters Patent is hereby corrected as shown below:

Column 1, line 31 - after "this" insert --approach is shown--.
Column 1, line 68 - before "the" (first occurrence) insert --uses--.
Column 8, line 17 - "fist" should be --first--.

Signed and Sealed this

Second Day of February, 1993

*Attest:*

STEPHEN G. KUNIN

*Attesting Officer*

*Acting Commissioner of Patents and Trademarks*